US010130163B2

(12) United States Patent
Zhijian

(10) Patent No.: US 10,130,163 B2
(45) Date of Patent: Nov. 20, 2018

(54) BACKPACK FOR CONVENIENT CHARGING

(71) Applicant: Li Zhijian, Fujian (CN)

(72) Inventor: Li Zhijian, Fujian (CN)

( * ) Notice: Subject to any disclaimer, the term of this patent is extended or adjusted under 35 U.S.C. 154(b) by 0 days.

(21) Appl. No.: 14/709,542

(22) Filed: May 12, 2015

(65) Prior Publication Data

US 2015/0366333 A1 Dec. 24, 2015

(30) Foreign Application Priority Data

Jun. 20, 2014 (CN) ..... 2014 2 0333026 U
Dec. 5, 2014 (WO) ..... PCT/CN2014/093101

(51) Int. Cl.
*A45F 4/02* (2006.01)
*A45C 15/00* (2006.01)
*A45F 3/04* (2006.01)

(52) U.S. Cl.
CPC ..... *A45F 4/02* (2013.01); *A45C 15/00* (2013.01); *A45F 3/04* (2013.01)

(58) Field of Classification Search
CPC ..... A45F 4/02; A45F 3/04; A45C 15/00
See application file for complete search history.

(56) References Cited

U.S. PATENT DOCUMENTS 6,816,760 B1 11/2004 Namaky
6,870,089 B1 * 3/2005 Gray ..... H01L 31/042 136/200
2002/0198031 A1 * 12/2002 Holmes ..... H04M 1/6091 455/569.2
2005/0140331 A1 * 6/2005 McQuade ..... A45C 15/00 320/101
2007/0297149 A1 12/2007 Richardson
2008/0011799 A1 * 1/2008 Chang ..... A45C 15/00 224/576
2008/0125164 A1 * 5/2008 Singh ..... H04M 1/0258 455/550.1
2008/0210728 A1 * 9/2008 Bihn ..... A45F 3/04 224/576
2009/0061926 A1 * 3/2009 Lee ..... H04M 1/6066 455/556.1
2009/0224722 A1 * 9/2009 Causey ..... H02J 7/355 320/101
2009/0276089 A1 11/2009 Bartholomew
2011/0110514 A1 * 5/2011 Gustavsson ..... H04M 1/6058 379/430

(Continued)

FOREIGN PATENT DOCUMENTS

KR 2014132850 A 11/2014

*Primary Examiner* — Scott McNurlen
(74) *Attorney, Agent, or Firm* — Jennifer Meredith, Esq.; Meredith & Keyhani, PLLC

(57) ABSTRACT

A backpack for convenient charging, the backpack comprising: a backpack body with a battery storage space to accommodate a storage battery unit; at least one strap connected to the backpack body, where at least one strap has a fixture for fixing a product to be charged and a power cable output port proximal to the fixture; wherein the backpack body further includes at least one cable passage leading from the battery storage space to the power cable output port to accommodate at least one power cable each with a first end and a second end, wherein at least one of the first end and the second end of the at least one power cable is connected to the storage battery unit to be charged.

18 Claims, 3 Drawing Sheets

(56) References Cited

U.S. PATENT DOCUMENTS

| | | | | |
|---|---|---|---|---|
| 2012/0262117 | A1 | 10/2012 | Ferber | |
| 2012/0299528 | A1* | 11/2012 | Scarmozzino | A45C 5/02 320/101 |
| 2013/0026726 | A1* | 1/2013 | Thomas | A45C 5/14 280/43.1 |
| 2013/0162389 | A1 | 6/2013 | Crucs | |
| 2013/0214931 | A1* | 8/2013 | Chia | H02J 7/0042 340/815.4 |
| 2013/0249673 | A1 | 9/2013 | Ferrari | |
| 2014/0002239 | A1 | 1/2014 | Rayner | |
| 2014/0061273 | A1* | 3/2014 | Bullivant | A45F 3/04 224/576 |
| 2014/0171132 | A1 | 6/2014 | Ziemianska | |
| 2015/0296644 | A1 | 10/2015 | Chin | |
| 2015/0326044 | A1 | 11/2015 | Ashley | |
| 2015/0359127 | A1 | 12/2015 | Daoura | |
| 2015/0366333 | A1 | 12/2015 | Zhijian | |
| 2016/0141904 | A1 | 5/2016 | Zhijian | |

* cited by examiner

BACKPACK FOR CONVENIENT CHARGING

TECHNICAL FIELD

This utility model relates to a backpack, particularly a backpack for convenient charging

BACKGROUND TECHNOLOGY

With the continuous development of society, various types of portable digital devices have become essential to people's daily life, e.g. tablet computer, cell phone, MP5, digital camera, camcorder, etc. Tourists, field workers and long-term travelers find it very inconvenient to charge these digital devices when they are running out of electricity and therefore have to suffer tremendous inconvenience and troubles at work and life. Prior art backpacks do not allow charging; or a mobile power source may be provided in the backpack; however, it requires the user to remove the backpack for the charging and charging is disabled when the mobile power source is running out. Therefore, the prior art is inconvenient in operation.

Scope of the Utility Model

The present invention overcomes the foregoing defects by providing a backpack for convenient charging; it allows the user to readily charge the product to be charged while conveniently carrying the backpack during walking, without the need to remove the backpack and take out the power source. It also liberates both hands and brings substantial convenience to operation.

The present invention is realized as follows: a backpack for convenient charging, said backpack comprising a backpack body and straps connecting to the backpack body; the backpack body is furnished with a storage battery space to accommodate a storage battery unit; the straps are furnished with a fixture for fixing of the product to be charged and a power cable output port near the fixture. The backpack body further includes cable passage A leading from the storage battery space towards the power cable output port to accommodate power cable A; both ends of power cable A are connected to the storage battery unit and the product to be charged respectively.

When the product to be charged is running out of electricity during walking, put the storage battery unit (e.g. power bank) into the storage battery space, introduce power cable A through cable passage A, connect one end of the cable to the storage battery unit and the other end to the outer end of the power cable output port; it is only necessary to place the product to be charged into the fixture on the straps and connect it to power cable A for charging, without the need to remove the backpack and take out the power source. It also liberates both hands.

Further, said cable passage is located inside the backpack; said fixture comprises bags on the front side of the straps; said power cable output port is located above the fixture.

Further, the unit further comprises storage battery unit installed in the storage battery space and power cable A introduced through cable passage A.

In order to continue charging despite exhaustion of the storage battery unit in the field, the casing of said backpack body is furnished with solar panel; said backpack body includes cable passage B leading from storage battery space towards the installing place of solar panel to accommodate power cable B; both ends of said power cable B are connected to the storage battery unit and the solar panel.

In order to allow convenient storage of other products to be charged and charge them accordingly, said backpack body is furnished with more than one storage space to accommodate other articles and another cable passage leading from said storage battery space towards such storage spaces to accommodate other power cables.

To make it convenient for the use of a Bluetooth device on the product to be charged, the output terminal of said power cable A further includes a Bluetooth actuator to actuate and energize the Bluetooth unit on the product to be charged.

BRIEF SUMMARY OF THE INVENTION

By way of introduction only, the present invention provides a backpack for convenient charging, said backpack comprising: a backpack body with a battery storage space to accommodate a storage battery unit; at least one strap connected to the backpack body, where at least one strap has a fixture for fixing a product to be charged and a power cable output port proximal to the fixture; wherein the backpack body further includes at least one cable passage leading from the battery storage space to the power cable output port to accommodate at least one power cable each with a first end and a second end, wherein the two ends of the at least one power cable are connected to the storage battery unit to be charged.

According to another aspect of the present invention, A backpack for convenient charging, said backpack comprising: a backpack body with a battery storage space to accommodate a storage battery unit; two straps connected to the backpack body, where at least one strap has a fixture for fixing a product to be charged and a power cable output port proximal to the fixture and wherein the power cable output port is installed above fixture; wherein the backpack body further includes at least one cable passage leading from the battery storage space to the power cable output port to accommodate at least one power cable each with a first end and a second end, wherein the two ends of the at least one power cable are connected to the storage battery unit to be charged.

Symbols: 1. Backpack body; 1-1 Storage battery space; 1-2 Storage space; 2. Straps; 3. Storage battery unit; 4. Fixture; 5. Power cable output port; 6. Power cable A; 7. Solar panel; 8. Power cable B; 9. Other power cables; 10. Bluetooth actuator; 11. GPS unit

DETAILED DESCRIPTION OF THE INVENTION

Figure 1:
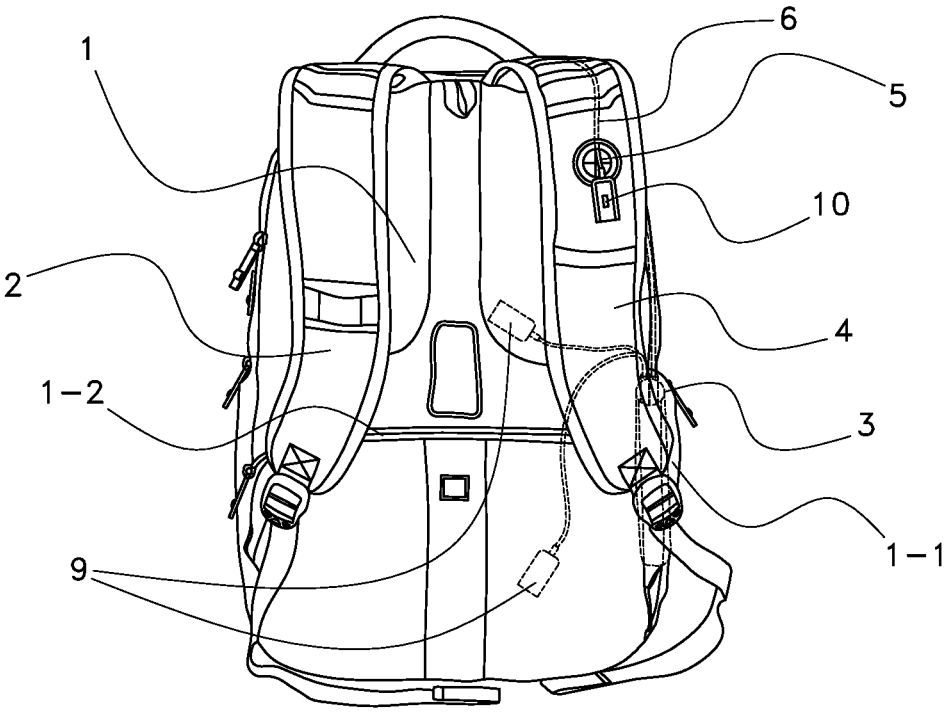
FIG. 1 is the 3D structure diagram of the back side of this utility model.
Figure 2:
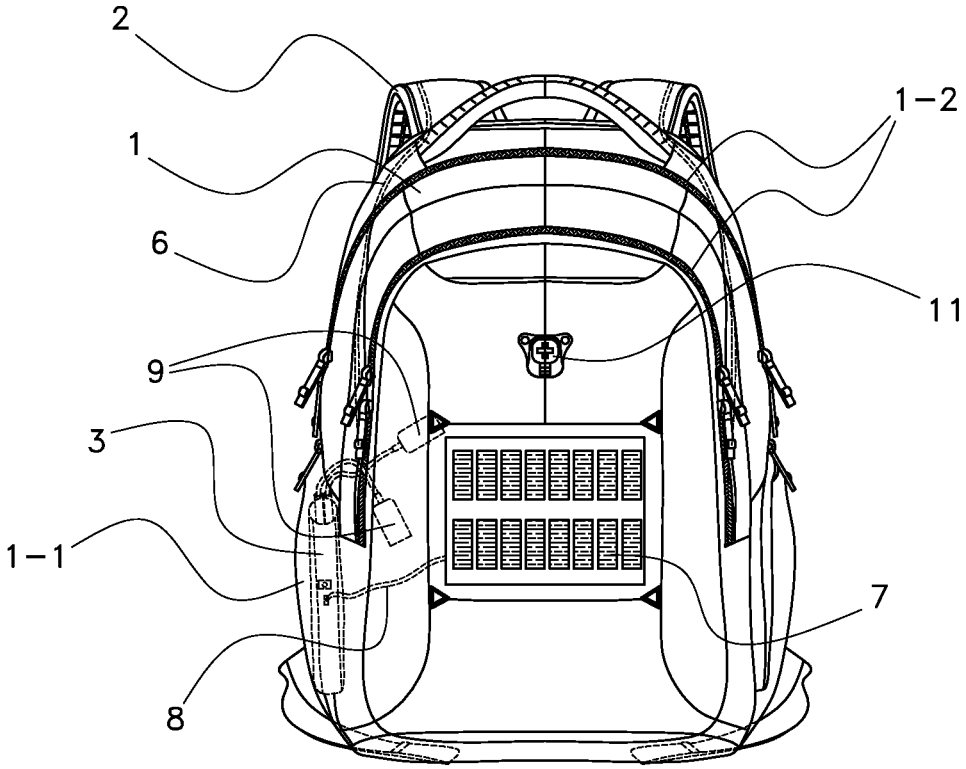
FIG. 2 is the 3D structure diagram of the front side of this utility model.
Figure 3:
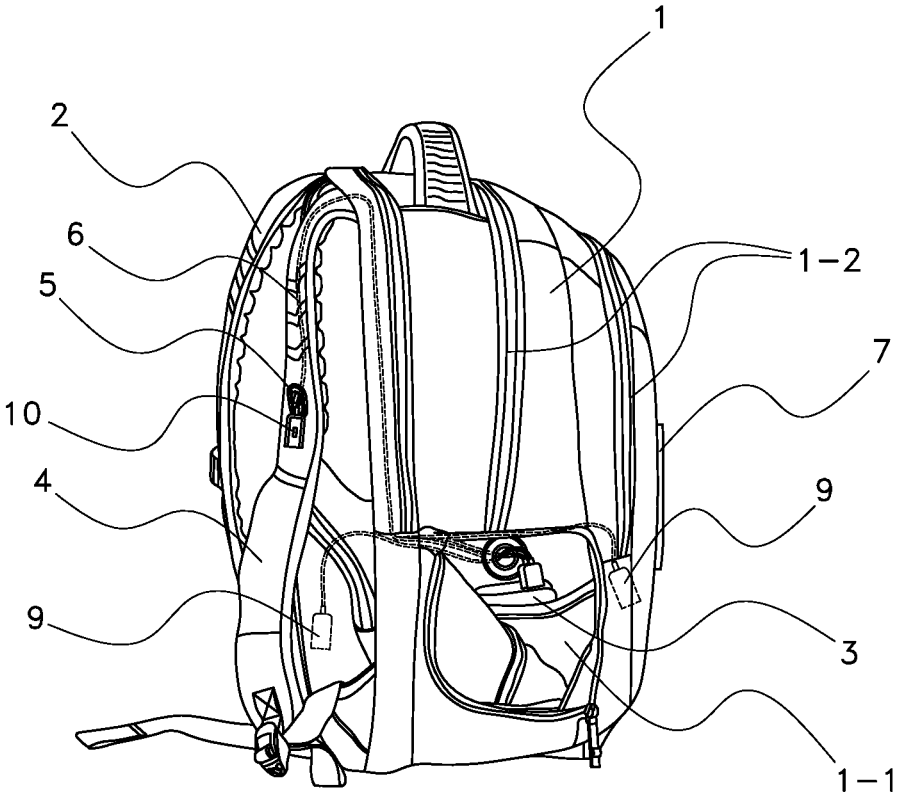
FIG. 3 is the 3D structure diagram of the lateral side of this utility model.

The following is a detailed description of this utility model with reference to the attached drawings and the specific embodiments: FIGS. 1-3 depict the backpack for convenient charging disclosed by this utility model. The backpack comprises backpack body (1) and straps (2) connecting to backpack body (1); backpack body (1) is furnished with storage battery space (1-1) to accommodate storage battery unit (3); straps (2) are furnished with fixture (4) for fixing of the product to be charged and power cable output port (5) near fixture (4). Backpack body (1) further includes cable passage A leading from storage battery space (1-1) towards power cable output port (5) to accommodate power cable A (6); both ends of power cable A are connected to storage battery unit (3) and the product to be charged respectively. Said backpack may be a backpack, a travel bag, a travel case, etc.

When the product to be charged is running out of electricity during walking, put storage battery unit 3 (e.g. power bank) into storage battery space 1-1, introduce power cable A 6 through cable passage A, connect one end of the cable to storage battery unit 3 and the other end to the outer end of the power cable output port 5; it is only necessary to place the product to be charged into fixture 4 on straps 2 and connect it to power cable A 6 for charging, without the need to remove the backpack and take out the power source. It also liberates both hands.

As FIG. 1 shows, said cable passage A is installed inside backpack body (1); said fixture (4) comprises a bag mounted on the front side of straps (2); said power cable output port (5) is installed above fixture (4). Surely, cable passage A may also be installed outside backpack body 1 and power cable output port 5 may be furnished elsewhere so long as it is convenient for charging. Further, this unit further comprises storage battery unit (3) installed in storage battery space (1-1) and power cable A (6) introduced through cable passage A.

In order to ensure continuation of charging upon exhaustion of the storage battery unit in a field environment, as FIG. 2 shows, the casing of said backpack body (1) is furnished with solar panel (7); said backpack body (1) includes cable passage B leading from storage battery space (1-1) towards the installing place of solar panel (7) to accommodate power cable B (8); both ends of said power cable B (8) are connected to storage battery unit (3) and solar panel (7). Inexhaustible solar energies are adopted to protect the environment.

In order to accommodate other products to be charged and charge them accordingly, said backpack body (1) is furnished with more than one storage space (1-2) to accommodate other articles and another cable passage leading from said storage battery space (1-1) towards storage space (1-2) to accommodate other power cables (9). For instance, place a tablet computer or a digital camera in storage space 1-2 and connect it to other power cables 9 for charging.

To make it convenient for use of any Bluetooth device on the product to be charged, as FIG. 1 or FIG. 3 shows, the output terminal of said power cable A (6) further includes Bluetooth actuator (10) to actuate and energize the Bluetooth unit on the product to be charged. It is only necessary to press Bluetooth actuator 10 to turn on the Bluetooth device on the product to be charged without the need to take out the product to be charged from fixture 4.

In order to enable real-time positioning of the backpack for convenient charging of this utility model, as FIG. 2 shows, said backpack body 1 is further furnished with GPS unit 11. Real-time positioning offers many advantages, e.g. finding the backpack when it is lost; the rescued target can be positioned on a real-time basis in the field.

A backpack for convenient charging is provided. The backpack comprising: a backpack body (1) with a battery storage space (1-1) to accommodate a storage battery unit (3); at least one strap (2) connected to the backpack body (1), where at least one strap (2) has a fixture (4) for fixing a product to be charged and a power cable output port (5) proximal to the fixture (4); the backpack body further includes at least one cable passage (e.g. the area surrounding power cable 6) leading from the battery storage space (1-1) to the power cable output port (5) to accommodate at least one power cable (e.g. 6) each with a first end and a second end, wherein one end of the at least one power cable (6) is connected to the storage battery unit (3) to be charged. This is to say it may be either the first end or the second end connected to the storage battery unit (3). The cable passage(s) may be inside the backpack body. The fixture may be a bag (or pouch) mounted on the front side of the at least one strap. The strap may be on the left strap, right strap or both. This may accommodate the comfort of the user. The power cable output port (5) may be installed above the fixture (4). This is useful to allow a phone (for example) to be supported in the fixture (4) and the power cable inserted easily into the top of the phone. The at least one cable passage may be inside the backpack body and between the power cable output port and the battery storage space. There may be a storage battery unit (3) installed in storage battery space (1-1) and at least one power cable (6) is introduced through a first of the at least one cable passages.

The casing of the backpack body (1) is furnished with at least one solar panel (7) and the backpack body includes a cable passage leading from storage battery space towards the installing place of solar panel to accommodate a power cable; wherein a first end and a second end of the power cable are connected to the storage battery unit and solar panel. The backpack body may be furnished with at least one additional storage space (1-2) to accommodate other articles and another cable passage leading from the at least one additional storage space to accommodate other power cables. The power cable may be further comprising an output terminal, a Bluetooth actuator (10) to actuate and energize the Bluetooth unit on the product to be charged. The backpack body may further includes GPS unit (11). The power cable output port (5) may be comprised of a plus (+) shaped center portion. This is shown in FIG. 1. This is important as it would hold the power cable in place and prevent it from being pulled through the opening.

The foregoing embodiments are detailed explanations of the technical solution of this utility model. This utility model is not restricted to the foregoing embodiments. Any improvement or substitution made according to principles of this utility model shall be within the scope of protection of this utility model.

I claim:

1. A backpack for convenient charging, said backpack comprising:

a backpack body with a battery storage space to accommodate a storage battery unit;

at least one strap connected to the backpack body, wherein the at least one strap has a fixture for fixing a product to be charged and a power cable output port proximal to the fixture;

a Bluetooth actuator, wherein the Bluetooth actuator has a Bluetooth actuator button that in response to a user pressing the Bluetooth actuator button actuates a Bluetooth unit on the product to be charged;

at least one power cable each with a first end and a second end, wherein at least one of the first end and the second end has the Bluetooth actuator therein;

wherein the backpack body further includes at least one cable passage leading from a first port inside the battery storage space to the power cable output port to accommodate the at least one power cable each with a first end and a second end, wherein at least one of the first end and the second end of the at least one power cable is connected inside the battery storage space and retained through the first port and wherein at least a portion of the Bluetooth actuator is retained outside the backpack body by the power cable output port next to the fixture.

2. The backpack as in claim 1, wherein one of said at least one cable passages is inside the backpack body and said fixture comprises a bag mounted on the front side of the at least one strap.

3. The backpack as in claim 1, wherein said power cable output port is installed above the fixture.

4. The backpack as in claim 1, wherein said at least one cable passage is inside the backpack body and between the power cable output port and the battery storage space.

5. The backpack as in claim 1, wherein the backpack further comprises a storage battery unit installed in the storage battery space and at least one power cable introduced through a first of the at least one cable passages.

6. The backpack as in claim 1, wherein the backpack body is furnished with at least one solar panel and the backpack body includes a cable passage leading from the storage battery space towards an installing place of the solar panel to accommodate a power cable; wherein a first end and a second end of the power cable are connected to the storage battery unit and solar panel.

7. The backpack as in claim 1, wherein the backpack body is furnished with at least one additional storage space to accommodate other articles and another cable passage leading from the at least one additional storage space to accommodate other power cables.

8. The backpack of claim 1, wherein the power cable further comprises an output terminal.

9. The backpack of claim 1, wherein said backpack body further includes a GPS unit.

10. The backpack of claim 1, wherein the power cable output port is comprised of a plus (+) shaped center portion.

11. A backpack for convenient charging, said backpack comprising:

a backpack body having a battery storage space to accommodate a storage battery unit;

two straps connected to the backpack body, wherein at least one strap has a fixture for fixing a product to be charged and a power cable output port proximal to the fixture and wherein the power cable output port is above the fixture;

a Bluetooth actuator, wherein the Bluetooth actuator has a Bluetooth actuator button that in response to a user pressing the Bluetooth actuator button actuates a Bluetooth unit on the product to be charged;

at least one power cable each with a first end and a second end, wherein at least one of the first end and the second end has the Bluetooth actuator therein;

wherein the backpack body further includes at least one cable passage leading from a first port inside the battery storage space to the power cable output port to accommodate the at least one power cable each with a first end and a second end, wherein at least one of the first end and the second end of the at least one power cable is connected inside the battery storage space and retained through the first port and wherein at least a portion of the Bluetooth actuator is retained outside the backpack body by the power cable output port next to the fixture.

12. The backpack as in claim 11, wherein one of said at least one cable passages is inside the backpack body and said fixture comprises a bag mounted on the front side of the at least one strap.

13. The backpack as in claim 11, wherein said at least one cable passage is inside the backpack body and between the power cable output port and the battery storage space.

14. The backpack as in claim 11, wherein the backpack further comprises a storage battery unit installed in the storage battery space and at least one power cable introduced through a first of the at least one cable passages.

15. The backpack as in claim 11, wherein the backpack body is furnished with at least one solar panel and the backpack body includes a cable passage leading from the storage battery space towards an installing place of the solar panel to accommodate a power cable; wherein a first end and a second end of the power cable are connected to the storage battery unit and solar panel.

16. The backpack as in claim 11, wherein the backpack body is furnished with at least one additional storage space to accommodate other articles and another cable passage leading from the at least one additional storage space to accommodate other power cables.

17. The backpack for convenient charging of claim 11, wherein the power cable further comprises an output terminal.

18. The backpack of claim 11, wherein said backpack body further includes a GPS unit.

* * * * *